US005088623A

United States Patent [19]

Crawford

[11] Patent Number: 5,088,623

[45] Date of Patent: Feb. 18, 1992

[54] DISPENSER WITH INDICATOR

[75] Inventor: John C. Crawford, Lake Mahopac, N.Y.

[73] Assignee: Colgate-Palmolive Co., Piscataway, N.J.

[21] Appl. No.: 216,071

[22] Filed: Jul. 7, 1988

[51] Int. Cl.[5] ..... B67D 5/38

[52] U.S. Cl. ..... 222/40; 222/136

[58] Field of Search ..... 222/23, 1, 40, 41, 47, 222/136, 129, 391; 221/6

[56] References Cited

U.S. PATENT DOCUMENTS

| | | | |
|---|---|---|---|
| 2,789,731 | 4/1957 | Marrafini | 222/129 |
| 3,184,120 | 5/1965 | Undi | 222/49 |
| 3,442,424 | 5/1969 | Prussin et al. | 222/94 |
| 4,437,591 | 3/1984 | van Schuckmann | 222/391 |
| 4,461,403 | 7/1984 | Prahs | 222/129 |
| 4,673,106 | 6/1987 | Fishman | 222/80 |
| 4,782,983 | 11/1988 | Cook | 222/45 |

*Primary Examiner*—Joseph E. Valenza
*Assistant Examiner*—Steve Reiss
*Attorney, Agent, or Firm*—Michael J. McGreal; Murray M. Grill; Robert C. Sullivan

[57] ABSTRACT

A dispenser comprising, a container having a chamber for retaining a flowable material, and a nozzle defining an outlet orifice. The dispenser has a device for pumping the material through the orifice. The dispenser has a first flowable material of a first regular color arranged in the chamber to be pumped first through the orifice. The dispenser also has a second flowable material of a second color which contrasts with the first color arranged in the chamber to be pumped last through the orifice when the chamber is nearly empty of the material.

15 Claims, 1 Drawing Sheet

FIG. 1
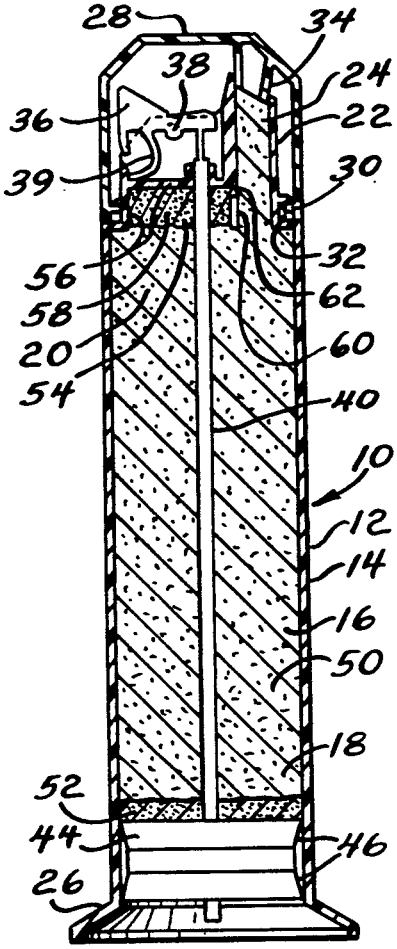
FIG. 3
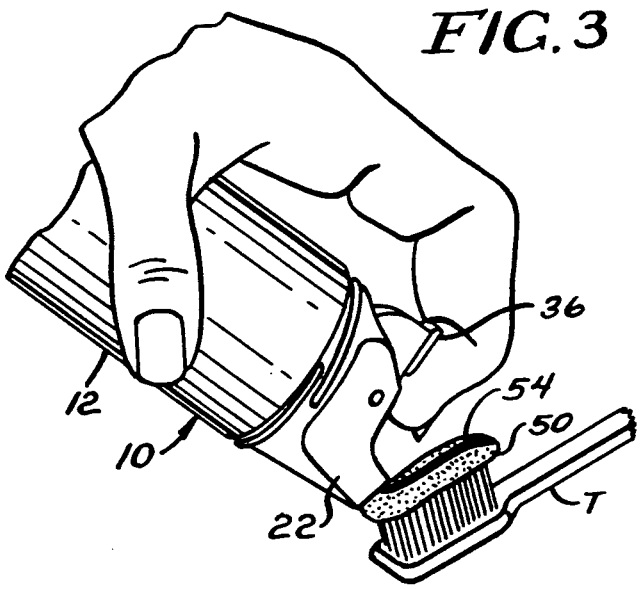
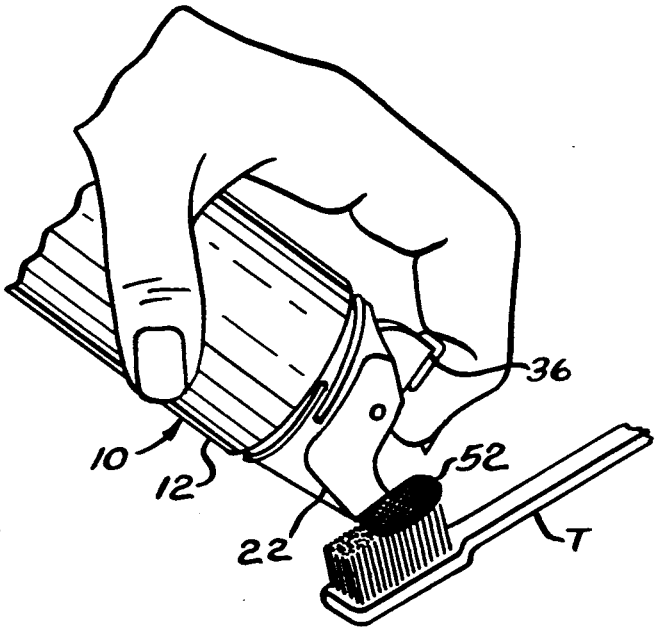
FIG. 4
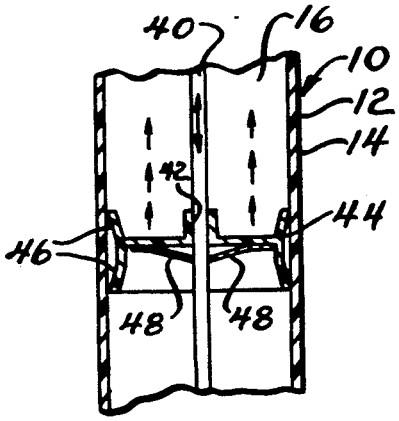
FIG. 2

DISPENSER WITH INDICATOR

BACKGROUND OF THE INVENTION

The present invention relates to dispensers for a flowable material, such as toothpaste.

Conventionally, toothpaste has been sold in squeezable tubes. Recently, dispensers for toothpaste have been introduced in which the toothpaste is pumped from a chamber through an outlet orifice. Although these dispensers work satisfactorily, it is desirable to determine when the chambers of the dispensers are nearly empty to indicate when the dispensers should be discarded and another one be purchased. Dispensers are disclosed in U.S. Pat. Nos. 4,437,591 and 4,461,403, incorporated herein by reference.

SUMMARY OF THE INVENTION

A principal feature of the present invention is the provision of an improved dispenser for a flowable material.

The dispenser of the present invention comprises, a container having a wall defining an elongated chamber to retain a flowable material, with the chamber having an upper portion and a lower portion, and a nozzle adjacent the upper portion of the chamber defining an outlet orifice. The dispenser has a plunger adjacent the lower portion of the chamber and sealingly engaging against an inner surface of the wall. The dispenser has means for moving the plunger upwardly in the chamber to pump a portion of the material through the orifice. The dispenser has a first flowable material of a first color received in the chamber and extending from the upper portion of the chamber to a location adjacent the plunger.

A feature of the present invention is that the dispenser has a second flowable material of a second color which contrasts with the first color located between the first material and the plunger.

Another feature of the invention is that the first material will be pumped initially through the outlet orifice by the plunger for use by the consumer.

Yet another feature of the invention is that after total use of the first material, the second material of the second color will be pumped by the plunger through the outlet orifice in a solid color.

Thus, a feature of the present invention is that when the material of the second color is pumped through the orifice this condition indicates that the chamber is nearly empty, and the dispenser may be discarded.

A further feature of the invention is that the chamber may contain a third flowable material of a third color which contrasts with the color of the first material adjacent an upper portion of the chamber in order to stripe the first material.

Further features will become more fully apparent in the following description of the embodiments of this invention and from the appended claims.

DESCRIPTION OF THE DRAWINGS

In the drawings:

FIG. 1 is a sectional view of a dispenser of the present invention;

FIG. 2 is a fragmentary sectional view of a plunger for the dispenser of FIG. 1; and FIGS. 3 and 4 are perspective views illustrating use of the dispenser of FIG. 1.

DESCRIPTION OF THE PREFERRED EMBODIMENTS

Referring now to FIG. 1, there is shown a dispenser generally designated 10 for pumping a flowable material, such as toothpaste, from the dispenser. The dispenser 10 has a container 12 having a cylindrical wall 14 defining an elongated chamber 16. The chamber 16 has a lower portion 18 and an upper portion 20. The dispenser has a nozzle 22 adjacent the upper portion 20 of the chamber 16 defining an outlet orifice 24. The dispenser 10 has an enlarged base 26 for stability purposes when the dispenser is placed on a surface.

The dispenser 10 has a cap 28 which may be releasably secured to an upper portion of the container 12 by suitable means such as an inwardly directed rim 30 on a lower portion of the cap and a groove 32 in an upper portion of the container 12, with the rim 30 being received in the groove 32. The cap 28 may have an inner plug 34 which is received in the nozzle 22 in order to close the orifice 24 when the cap 28 is secured to the container 12.

The dispenser 10 has a lever 36 which is pivotally mounted by a pin 38 to an upper portion of the container 12. The lever 36 has a lower arcuate spring member 39 which biases the lever upwardly in the container. An elongated rod 40 is connected to an inner portion of the pivoted lever 36. With reference to FIGS. 1 and 2, the rod 40 extends through a central opening 42 of a plunger 44 which has flanges 46 which sealingly engage against an inner surface of the wall 14. The plunger 44 may be made of a flexible material, such as plastic or rubber. The plunger 44 has a plurality of lower clips 48 made from metal which are secured to a lower portion of the plunger 44 and which engage against the rod 40. As shown, the rod 40 is received between the clips 48.

In operation, when the lever 36 is moved downwardly the rod is moved upwardly in the chamber 16, and the plunger 44 is moved upwardly slightly in the chamber 16 due to engagement of the clips 48 against the rod 40 in order to pump a small portion of material in the chamber 16 through the outlet orifice 24. However, when the lever 36 is released, the spring member 39 moves the lever 36 upwardly, and the rod 40 moves downwardly through the plunger 44 and clips 48 while the plunger 44 remains in place. Thus, the lever 36 is repetitively moved downwardly in order to repetitively pump material from the chamber 16.

With reference to FIG. 1, the chamber 16 has a first flowable material 50 of a first color, such as toothpaste with a white color, received in the chamber 16 and extending from the upper portion 20 of the chamber 16 to a location adjacent the plunger 44 in the lower portion 18 of the chamber 16. Also, the chamber 16 has a second flowable material 52 of a second color, such as a red gel, which contrasts with the color of the first material 50 and located between the first material 50 and the upper part of the plunger 44. If desired, the chamber 16 may have a third flowable material 54 adjacent the upper portion 20 of the chamber of a color which contrasts with the color of the first material 50 in order to stripe the first material 50, such as a red gel. The container has walls 56 defining a cavity 58 adjacent the upper portion 20 of the chamber 16, with a lower part of the cavity 58 communicating with the chamber 16. The container has a bar 60 extending across the chamber 16 and defining a slit 62 adjacent the nozzle 22.

In use, the cap 28 is removed from the container 12 and the lever 36 is pumped in order to move the plunger 44 upwardly slightly in the chamber 16. As a result, a portion of the first material 50 is pumped through the outlet orifice 24, and a portion of the third material 54 is pumped through the slit 62 and orifice 24 in order to stripe the first material 50 as shown in FIG. 3. The lever 36 is repetitively pumped in this manner over a period of time in order to utilize the first material 50 in the chamber 16 and dispense it to place it on a toothbrush T. However, when the plunger 44 is located adjacent the upper portion 20 of the chamber 16, the second material 52 will be and dispensed pumped from the outlet orifice 24 in a solid color, such as red, as shown in FIG. 4, which indicates that the chamber 16 is nearly empty, and the dispenser should be discarded and another one purchased. In this manner, the dispenser of the present invention indicates the relative condition of the contents in the chamber 16, and when it is nearly empty.

In accordance with another aspect of the present invention, the first material 50 may have a first consistency, and the second material 52 may have a second consistency which differs from the consistency of the first material 50. Thus, after all of the material of the first consistency 50 has been pumped from the chamber 16, and the material of the second consistency 52 is pumped from the orifice 24, this condition indicates that the container 12 is nearly empty and should be discarded.

The foregoing detailed description is given for clearness of understanding only, and no unnecessary limitations should be understood therefrom, as modifications will be obvious to those skilled in the art.

I claim:

1. A dispenser, comprising:

a container having a chamber for retaining a flowable material, and a nozzle defining an outlet orifice;

means for pumping the material through the orifice;

a first flowable material of a first regular color arranged in the chamber to be pumped and dispensed first through the orifice; and a second flowable material of a second color which contrasts with the first color arranged in the chamber to be pumped and dispensed last through the orifice when the chamber is nearly empty of the material.

2. The dispenser of claim 1 wherein the first material comprises toothpaste.

3. The dispenser of claim 1 wherein the first material has a white color.

4. The dispenser of claim 1 wherein the second material comprises a gel.

5. The dispenser of claim 1 wherein the second material is red.

6. The dispenser of claim 1 wherein the first material is white and the second material is red.

7. The dispenser of claim 1 including a third flowable material having a color which contrasts with the first material and being arranged to be pumped simultaneously with the first material through the orifice to stripe the first material.

8. The dispenser of claim 7 wherein the third material comprises a gel.

9. The dispenser of claim 7 wherein the third material is red and the first material is white.

10. The dispenser of claim 1 wherein the colors of the second and third materials are the same.

11. A dispenser, comprising:

a container having a chamber for retaining a flowable material, and a nozzle defining an outlet orifice;

means for pumping and dispensing a major first flowable material of a first color through the orifice first; and means for pumping and dispensing a minor second flowable material of a second color which contrasts with the first color last through the orifice when the chamber is nearly empty.

12. A dispenser, comprising:

a container having a chamber for retaining a flowable material, and a nozzle defining an outlet orifice;

means for pumping and dispensing a major first flowable material of a first consistency through the orifice first; and means for pumping and dispensing a minor second flowable material of a second consistency which differs from the first consistency last through the orifice when the chamber is nearly empty.

13. A dispenser, comprising:

a container having a wall defining an elongated chamber to retain a flowable material, with said chamber having an upper portion and a lower portion, and a nozzle adjacent the upper portion of the chamber defining an outlet orifice.

a plunger adjacent the lower portion of the chamber and sealingly engaging against an inner surface of the wall;

means for moving the plunger upwardly in the chamber to pump and dispense a portion of the material through the orifice;

a first flowable material of a first color received in the chamber and extending from the upper portion of the chamber to a location adjacent the plunger; and a second flowable material of a second color which contrasts with the first color located between the first material and the plunger.

14. The dispenser of claim 13 including a third flowable material adjacent the upper portion of the chamber and arranged to be pumped with the first material through the orifice, said third material having a color which contrasts with the color of the first material to stripe the first material.

15. A dispenser, comprising:

a container having a wall defining an elongated chamber to retain a flowable material, with said chamber having an upper portion and a lower portion, and a nozzle adjacent the upper portion of the chamber defining an outlet orifice;

a plunger adjacent the lower portion of the chamber and sealingly engaging against an inner surface of the wall;

means for moving the plunger upwardly in the chamber to pump and dispense a portion of the material through the orifice;

a first lowable material of a first consistency received in the chamber and extending from the upper portion of the chamber to a location adjacent the plunger; and a second flowable material of a second consistency which differs from the first consistency located between the first material and the plunger.

* * * * *